US005341770A

United States Patent [19]

Lannes

[11] Patent Number: 5,341,770

[45] Date of Patent: Aug. 30, 1994

[54] INTEGRAL LIME INHIBITOR

[75] Inventor: Eric M. Lannes, Kentwood, Mich.

[73] Assignee: Bradford-White Corporation, Ambler, Pa.

[21] Appl. No.: 38,154

[22] Filed: Mar. 26, 1993

[51] Int. Cl.[5] ..... F22B 37/48

[52] U.S. Cl. ..... 122/383; 122/17; 122/380

[58] Field of Search ..... 122/380, 383, 399, 159, 122/17

[56] References Cited

U.S. PATENT DOCUMENTS

| | | | |
|---|---|---|---|
| 241,360 | 5/1881 | Hayes et al. . | |
| 349,046 | 9/1886 | Hooker . | |
| 2,592,863 | 9/1949 | Conner . | |
| 3,229,683 | 6/1961 | Russell et al. . | |
| 3,762,395 | 10/1973 | Taylor . | |
| 4,157,077 | 6/1979 | Lindahl . | |
| 4,257,355 | 3/1981 | Cook . | |
| 4,263,879 | 4/1981 | Lindahl . | |
| 4,505,231 | 3/1985 | Syler . | |
| 4,512,289 | 4/1985 | Collins . | |
| 4,714,053 | 12/1987 | Perry | 122/382 |
| 4,735,174 | 4/1988 | Crump | 122/159 X |
| 4,813,383 | 3/1989 | Daugirda | 122/159 |
| 4,838,211 | 6/1989 | Vago . | |
| 4,898,124 | 2/1990 | Granberg et al. . | |
| 4,898,150 | 2/1990 | Lewis . | |
| 4,905,900 | 3/1990 | Scharton et al. . | |
| 4,949,680 | 8/1990 | Kale . | |
| 5,152,843 | 10/1992 | McDonald et al. . | |

*Primary Examiner*—Edward G. Favors
*Attorney, Agent, or Firm*—Miller & Christenbury

[57] ABSTRACT

A water heater cold water inlet deflector means which creates turbulent flow within the inlet conduit and creates turbulent water circulation throughout the water storage tank so that sediment is disturbed and suspended, stacking is prevented and efficiency is improved.

14 Claims, 7 Drawing Sheets

INTEGRAL LIME INHIBITOR

BACKGROUND OF THE INVENTION

This invention relates to a water heater having an integral lime inhibiting system which prevents the accumulation of sediment on the inside surfaces of the water heater.

FIELD OF THE INVENTION

Sediment accumulation represents a serious problem which has plagued owners and manufacturers of both gas and electric water heaters. Heating of water promotes precipitation of sediment. Hot spots are likely to exist along the flue (in a gas water heater) and adjacent the combustion chamber of a gas water heater. Accumulated sediment tends to harden, forming a scale on various tank surfaces, which reduces water heater efficiency and, in many cases, leads to failure. Although some accumulated sediment can be partially removed by routine flushing, this is rarely performed with any regularity.

Accordingly, it is an important object of this invention to minimize or to prevent the accumulation of sediment in water heater tanks.

Although sediment accumulation preventing devices have been proposed, each of these devices has exhibited inadequate performance or encountered other significant disadvantages. The one disclosed in U.S. Pat. No 3,762,395 to Taylor requires a specific orientation before it can assist in the reduction of sediment accumulation. If installed improperly, such devices will not produce the desired effects and may even exaggerate sediment accumulation.

Several water heater manufacturers have attempted to use ring-shaped devices such as the one disclosed in U.S. Pat. No. 4,157,077 to Lindahl. These have complicated structures and are expensive to manufacture and difficult to install. Moreover, their complex and tortuous manipulation of water flow acts to restrict the flow of water as it enters the water storage tank.

Other prior art devices, such as the one disclosed by Cook in U.S. Pat. No. 4,257,355, utilize a cold water inlet tube having outward-facing nozzles on the tube and a closed end so as to direct water flow against the bottom surface of the water storage tank. These devices rely on the force of the water flow to "blast" the inside surfaces of water storage tanks.

Finally, modified dip tubes, such as the one disclosed in U.S. Pat. No. 4,898,150, redirect inlet water flow in an attempt to create a water swirl at the bottom of the water heater. Such devices, however, restrict the flow of water into the water storage tank and actually direct water flow away from the tank bottom.

Other disadvantages are associated with prior art devices intended to reduce sediment accumulation in water storage tanks.

Accordingly, there is a great and thus far unsatisfied demand for a system which prevents accumulation of sediment on the inside surfaces of water storage tanks without unduly increasing manufacturing costs, or requiring special orientation within the water storage tank, or restricting the flow of water into the water storage tank.

OBJECTS OF THE INVENTION

It is an object of this invention to provide an integral lime inhibiting system for water heaters capable of limiting or preventing the accumulation of sediment on the inside surfaces of water storage tanks.

It is another object of the invention to provide an inexpensive and standardized integral lime inhibiting system for water heaters.

It is a further object of the invention to provide an integral lime inhibiting system for water heaters capable of supplying water to water storage tanks without substantially restricting water flow.

It is a still further object of the invention to provide a lime inhibiting device for water heaters capable of being mounted horizontally, vertically, or in any other orientation within water storage tanks.

It is still another object of this invention to provide an integral lime inhibiting system for water heaters that provides improved hot water supply by performing a mixing function of the water within the water storage tank.

It is yet another object of this invention to provide an integral lime inhibiting system for water heaters which acts to minimize water heater maintenance requirements, reduce the need for energy to reheat water to replace the drawn off hot water and to extend the life of the water heater storage tank.

It is still a further object of this invention to provide an integral lime inhibiting system for water heaters which provides substantially uniform heat distribution throughout the water storage tank and reduces stacking.

Other objects and advantages of the present invention will become apparent to those skilled in the art from the appended drawings, of which:

SUMMARY OF THE INVENTION

Figure 1:
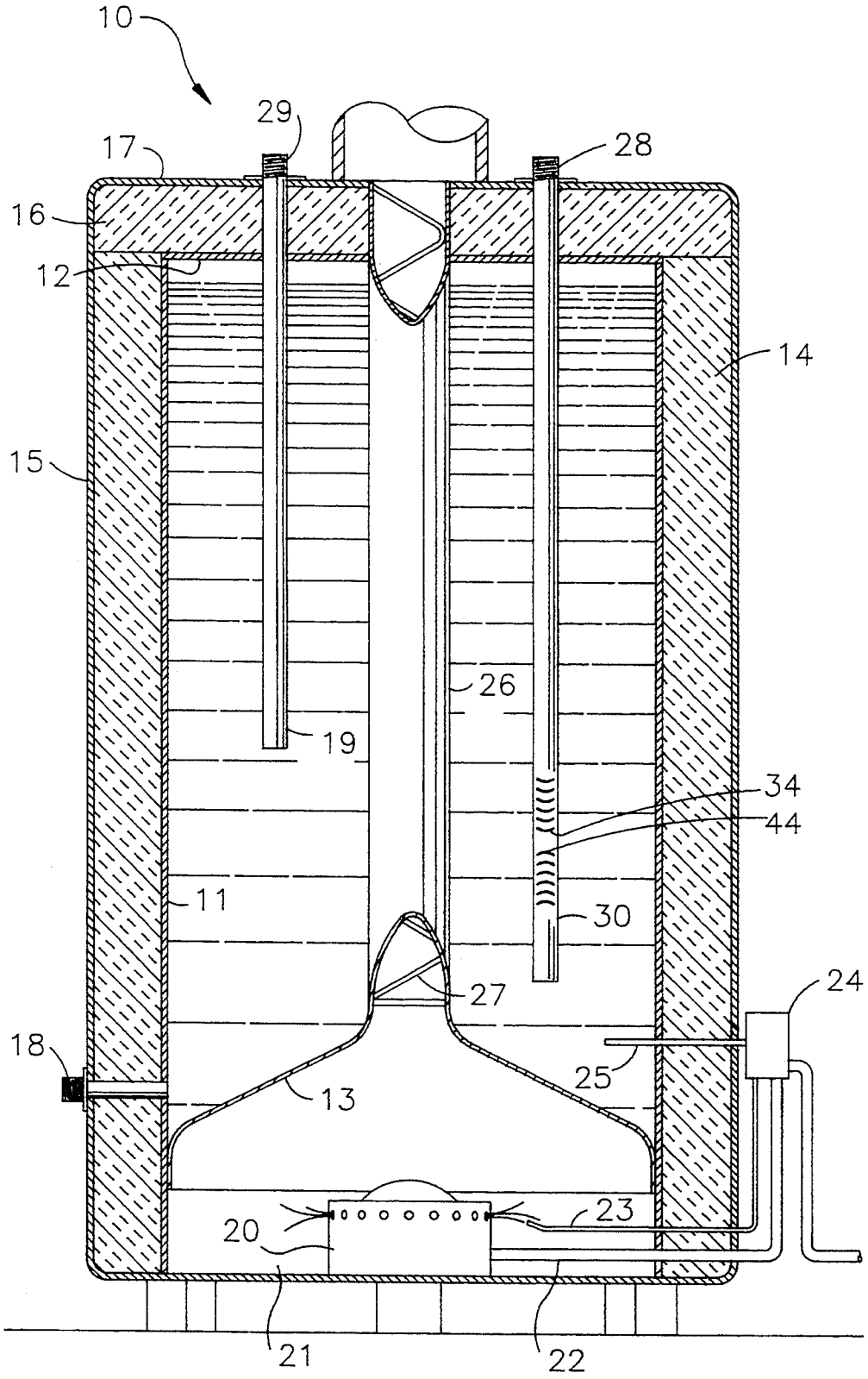
FIG. 1 is a cross-sectional side view of a gas water heater having an integral lime inhibiting system embodying features of this invention.

This invention relates to a water feed system for water heaters comprising a cold water inlet tube having flow deflectors or mixing elements formed in the wall of the cold water inlet tube to convert laminar and transitional flow to turbulent flow. These flow deflectors reduce boundary layer thicknesses along the wall of the cold water inlet tube to near zero, inducing turbulent flow in the tube, and increasing the Reynolds number of the water flow as it enters the water storage tank. This turbulent flow disturbs settled sediment and suspends the sediment in the water so that it can be removed with hot water drawn from the water heater during normal consumption, thereby reducing maintenance requirements, excessive energy usage and extending water heater longevity.

The flow deflectors also induce turbulent flow and promote water circulation throughout the water storage tank. The increased water circulation surprisingly reduces undesirable "stacking" which occurs when frequent, small draws create temperature layers and increased temperatures at the top of the water heater. The new system also surprisingly increases water heater heating capacity.

DETAILED DESCRIPTION OF THE INVENTION

The following description is intended to refer to specific embodiments of the present invention illustrated in the drawings. While a gas water heater has been selected for illustration in the drawings, the turbulation of incoming water is highly effective in electric and other water heaters. This description is not intended to define or limit the scope of the invention, which is defined separately in the claims that follow.

Referring to FIG. 1, the gas water heater 10 has a water tank 11 with a tank head 12 and a tank bottom 13. The water tank 11 is surrounded by an insulating layer 14 and an outer jacket 15. The tank head 12 is covered with an insulating layer 16 which is enclosed by a jacket top 17. A drainage outlet 18 permits drainage of water from the water tank 11, and a sacrificial anode 19 self-sacrifices to protect the water tank 11.

A gas burner 20 within a combustion chamber 21 receives combustion gas from a gas supply line 22. A source of ignition 23, along with the gas supply line 22, extends from a control means 24 having an immersion rod 25. A flue pipe 26 having a flue baffle 27 allows for the exhaust of combustion emissions from the combustion chamber 21. A cold water inlet port 28 and a hot water outlet port 29 are extended from the tank head 12, insulating layer 16, and jacket top 17. The cold water inlet port 28 may optionally have a nipple and/or heat trap.

A cold water inlet tube 30 is attached at the cold water inlet port 28. The cold water inlet tube 30 is specially configured according to the present invention, having water flow deflectors or turbulators 34 and/or 44 which will be described in further detail.

Figure 2:
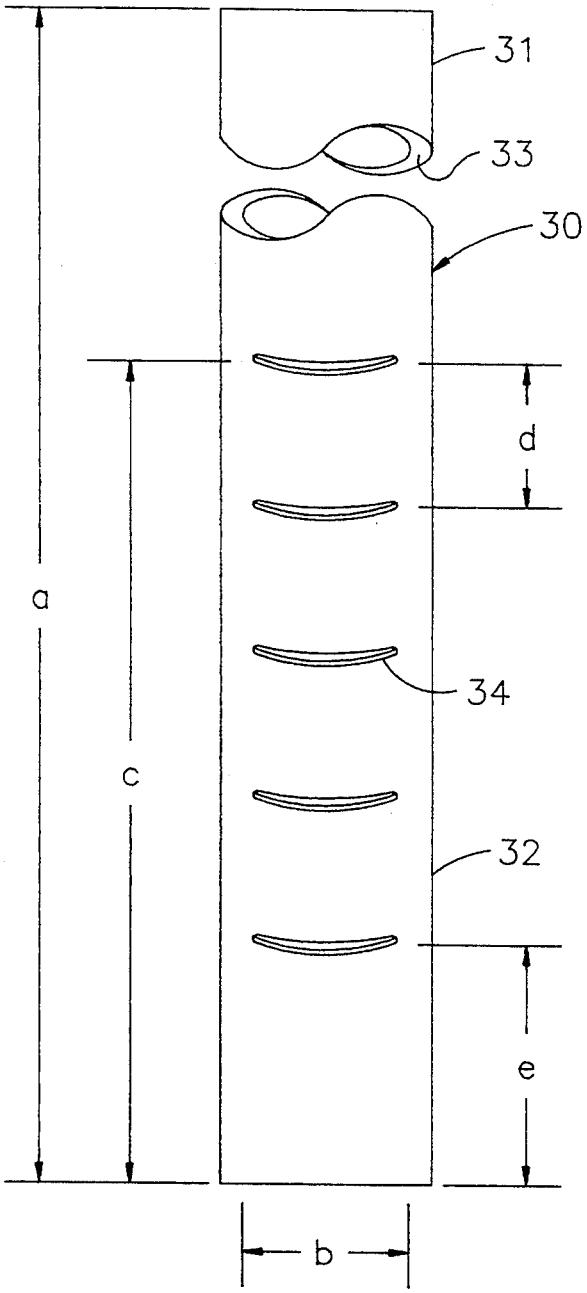
FIG. 2 is a side view of an integral lime inhibiting device including a water inlet conduit having smile-shaped notches.

Referring to FIG. 2, cold water inlet tube 30 has a distal end portion 32, a wall 33, a length a, and an inside diameter b. The flow deflectors of this invention are shown as smile-shaped notches 34, formed in the wall 33 of the integral lime inhibiting device 30, and formed at intervals d starting at a location c from the distal end of the tube 30. The smile-shaped notches 34 are formed in (and through) the wall 33 of the tube 30, ending at a distance e from the distal end of tube 30.

Figure 3:
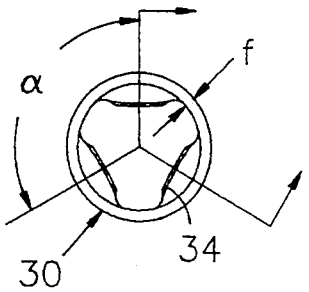
FIG. 3 is a top view of the integral lime inhibiting device shown in FIG. 2.

Referring to FIGS. 2 and 3, tube 30 has a wall thickness f and smile-shaped notches 34 equally spaced from each other at an angle $\alpha$. In this embodiment a group of three smile-shaped notches 34 share planes axially separated by the distance d between the notches 34; the three smile-shaped notches 34 within each plane are separated by an angle $\alpha$ that is approximately 120°.

Figure 4:
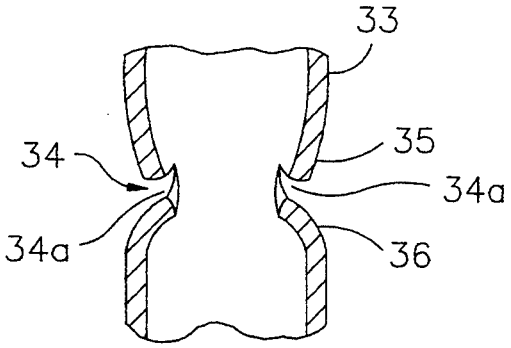
FIG. 4 is a side view of the integral lime inhibiting system shown in FIG. 2.

As illustrated in FIG. 4 each smile-shaped notch 34 has an upper lip 35 and a lower lip 36 in the wall 33 with openings 34(*a*) extending completely through the wall 33. The lower lip 36 extends farther toward the centerline of the tube 30 than the upper lip 35.

Figure 5:
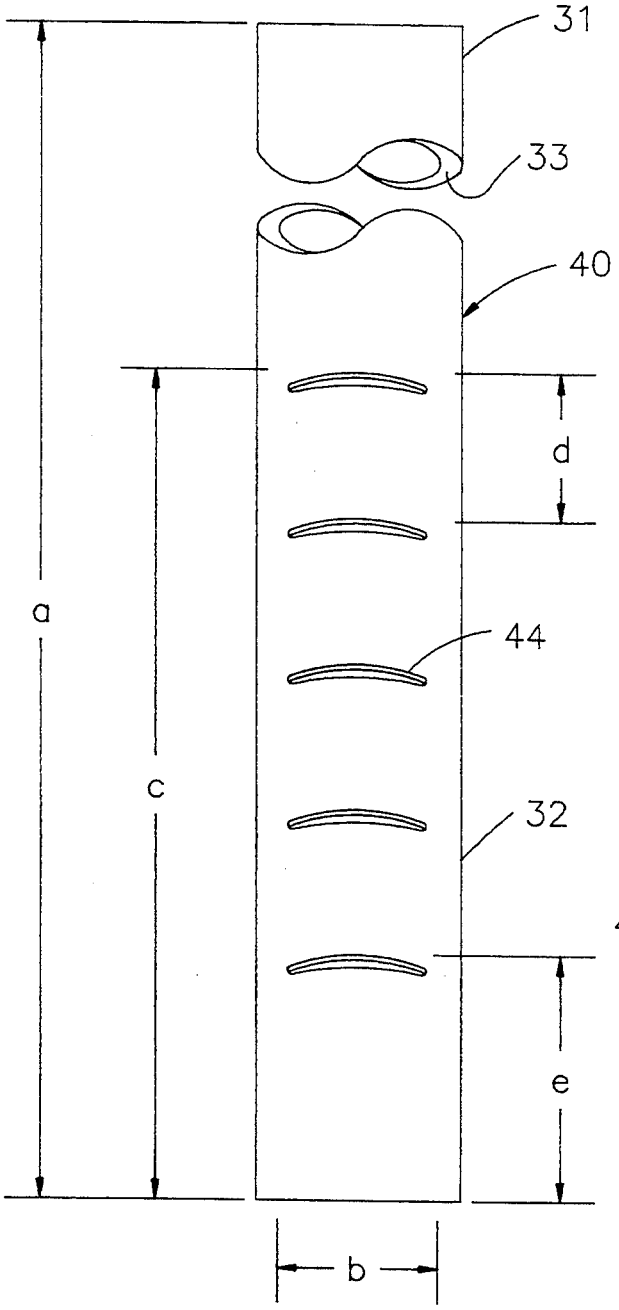
FIG. 5 is a side view of another embodiment of an integral lime inhibiting system having frown-shaped notches.

Referring to FIG. 5, the illustrated embodiment is provided with frown-shaped notches 44 formed in the wall 33 of tube 40, formed within a distance c from the distal end and axially separated by a distance d, the last one being at a distance e from the distal end of tube 40.

Figure 6:
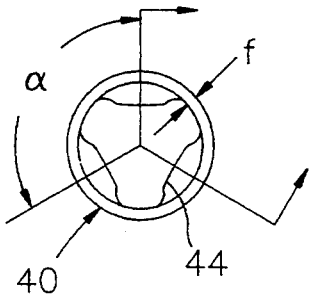
FIG. 6 is a top view of the integral lime inhibiting device shown in FIG. 5.

Referring to FIG. 6, the wall 33 has a thickness f, and the frown-shaped notches 44 are equally spaced at an angle $\alpha$. According to this embodiment, three frown-shaped notches 44 share each plane, and are separated by an angle $\alpha$ of approximately 120°.

Figure 7:
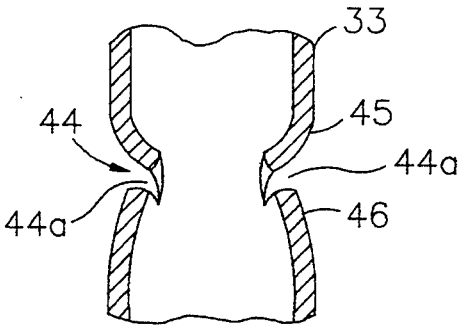
FIG. 7 is a side cross-sectional view of the integral lime inhibiting device shown in FIG. 5.
Figure 9:
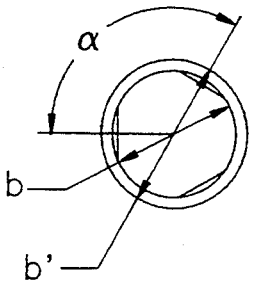
FIG. 9 is a top plan view of the integral lime inhibiting device shown in FIG. 8.
Figure 8:
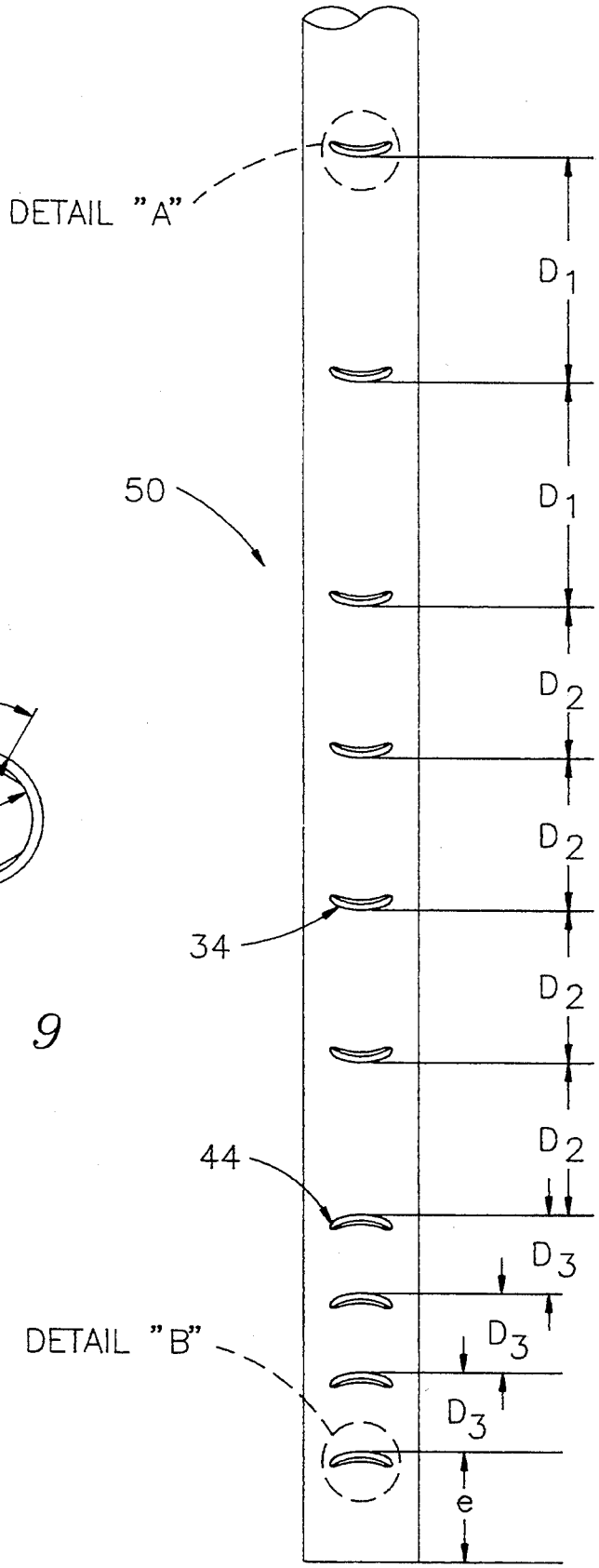
FIG. 8 is a side view of the best mode embodiment of an integral lime inhibiting system incorporating combined smile-shaped and frown-shaped notches.

Referring to FIG. 7, each frown-shaped notch 44 includes an upper lip 45 and a lower lip 46 formed in the wall 33 with openings 44(*a*) extending completely through the wall. With frown-shaped notches 44, unlike the smile-shaped notches 34 shown in FIG. 4, the upper lip 45 extends farther toward the centerline of the device 40 than the lower lip 46.

The tubes 30 and 40 may be of various materials and sizes but for many uses are preferably formed of polypropylene tubing having an outside diameter b' of approximately 0.750" and a wall thickness f of approximately 0.050". The lime inhibiting devices 30 and 40 are preferably open-ended at their distal end. Also, the distance d between notches 34 or 44 may vary becoming smaller toward the distal end of tube 30 or 40. The distance d between notches 34 and 44 is preferably related to the outside diameter b of the tube 30 or 40.

For example, tube 30 may have about 10 groups of three smile-shaped notches 34 within a distance c of 7.5" in the distal end portion 32. The tenth, ninth, and eighth groups of smile-shaped notches 34, formed in the uppermost portion of the distal end portion 32, may preferably be separated by a distance d of approximately 1.5", corresponding to approximately twice the preferred outside diameter b of the tube 30. The eighth, seventh, sixth, fifth, and fourth groups may preferably be separated by a distance d corresponding to the outside diameter b, or approximately 0.750". The fourth, third, second, and first groups of smile-shaped notches 34, located nearest the bottom of the distal end portion 32, may preferably be separated by a distance d corresponding to half the outside diameter b of the tube 30, or approximately 0.375". Accordingly, the distance e between the first group of smile-shaped notches 34 and the distal end of the tube 30 may preferably be approximately 0.375".

Similarly, the tube 40 preferably has any number such as 10 groups of three frown-shaped notches 44 within a distance c of 8" in the distal end portion 32 of the tube 40. The tenth, ninth, and eighth groups of frown-shaped notches 44, formed in the uppermost portion of the distal end portion 32, are preferably separated by a distance d of approximately 1.5", corresponding to twice the preferred outside diameter b. The eighth, seventh, sixth, fifth, and fourth groups are preferably separated by a distance d corresponding to the outside diameter b or approximately 0.750". The fourth, third, second, and first groups of frown-shaped notches 44, are preferably separated by a distance d corresponding to half the outside diameter b of tube 40, or approximately 0.375". Accordingly the distance e between the first group of frown-shaped notches 44 and the distal end of the 40 is preferably approximately 0.875". Various other relationships and spacings may of course be used.

The best mode of this invention will be described with reference to FIGS. 8–15, and is designated with the numeral 50. The tube 50 has both smile-shaped notches 34 and frown-shaped notches 44 separated by distances $D_1$, $D_2$, and $D_3$ from each other, and separated from the distal end of the tube 50 by the distance e. The distances $D_1$, $D_2$, and $D_3$ are approximately proportionate to the inside diameter b of the tube 50. It is preferred that $D_1$ equals 1.5", $D_2$ equals 1", and $D_3$ equals 0.5". The distance e from the distal end of the tube 50 is preferably 0.75". The preferred embodiment of the tube 50 has ten groups of notches, six groups of smile-shaped notches 34 and four groups of frown-shaped notches 44. The notches 34 or 44 within each group are separated by an angle $\alpha$ which is preferably 120°, and the notches 34 or 44 of adjacent groups form a line along the wall of the tube 50. In this preferred embodiment, the tube 50 preferably has an inside diameter b of approximately 0.625" and an outside diameter b' of approximately 0.75".

Figure 10:
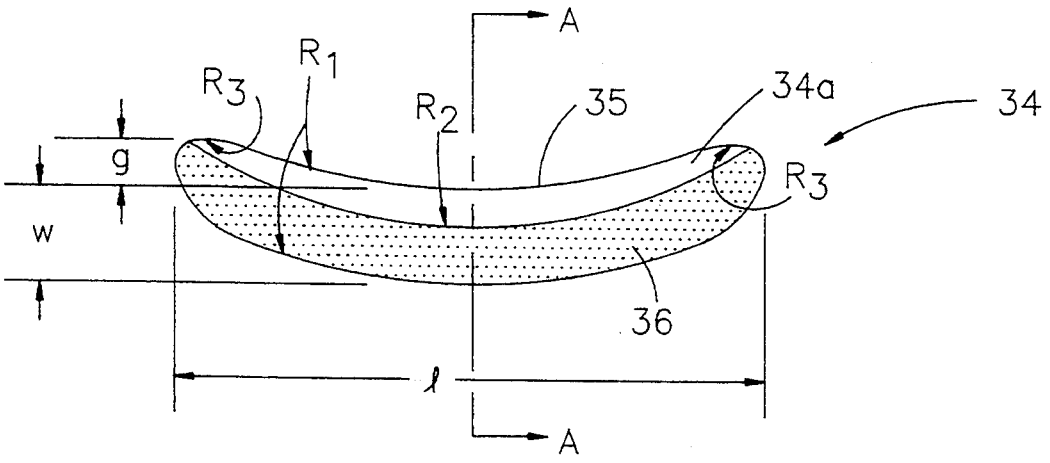
FIG. 10 is a front view of the detail of the smile-shaped notch in the integral lime inhibiting device shown in FIG. 8 indicated by detail "A"

Referring to FIG. 10, the smile-shaped notch 34 has an opening 34(*a*), an upper lip 35, and a lower lip 36. The smile-shaped notch 34 has a width w, defined as the distance from the bottom of the lower lip 36 to the bottom of the upper lip 35, of approximately 0.075". The smile-shaped notch 34 also has a distance g, measured from the bottom of the upper lip 35 to the uppermost edges of the opening 34(*a*), of approximately 0.053". The length 1 of the smile-shaped notch 34 is approximately 0.380", and the radii $R_1$, $R_2$, and $R_3$ are 0.250", 0.219", and 0.027", respectively.

Figure 11:
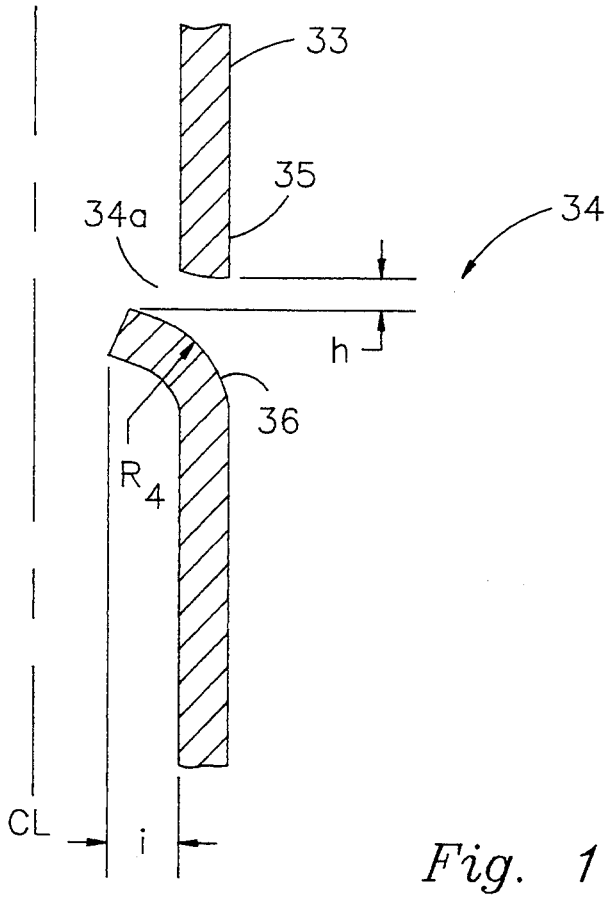
FIG. 11 is a side cross-sectional view of the smile-shaped notch shown in FIG. 10 defined by Section "AA"

Referring to FIG. 11, the best mode embodiment of the tube 50 has an opening 34(*a*) having a height h of approximately 0.035". The lower lip 36 of the smile-shaped notch 34 extends into the tube 50 and towards the central line CL a distance i of approximately 0.135". The curvature of the lower lip 36 has a radius $R_4$ of approximately 0.188". The upper lip 35 of the smile-shaped notch 34 remains substantially planar with respect to the wall 33 of the tube 50.

Figure 12:
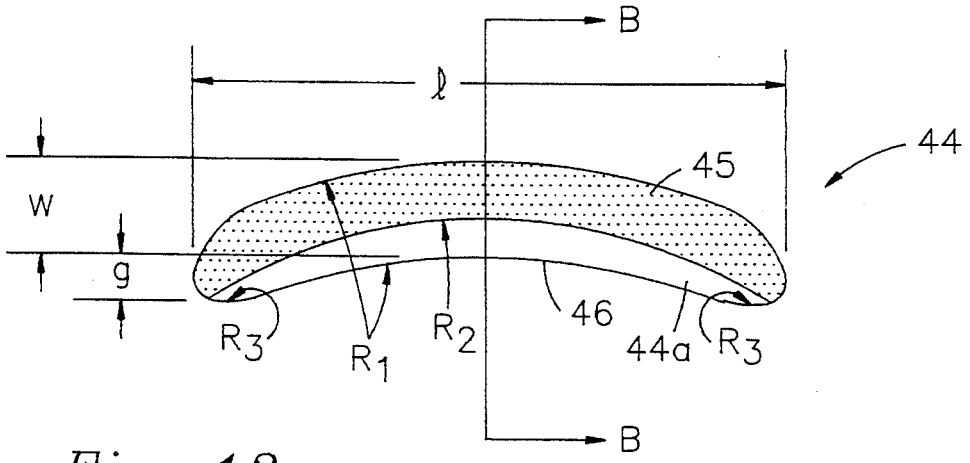
FIG. 12 is a front view of a frown-shaped notch in the integral lime inhibiting device shown in FIG. 8 as indicated by detail "B" in FIG. 8.

Referring to FIG. 12, the frown-shaped notches 44 in the tube 50 have openings 44(*a*), an upper lip 45, and a lower lip 46. The width w between the upper-most edge of the lower lip 46 and the uppermost edge of the upper lip 45 is approximately 0.075". The distance g between the lowermost edge of the opening 44(*a*) and the uppermost edge of the lower lip 46 is approximately 0.053". The radii $R_1$, $R_2$, and $R_3$ are preferably 0.250", 0.219", and 0.027", respectively. The length 1 of the frown-shaped notch 44 is approximately 0.380".

Figure 13:
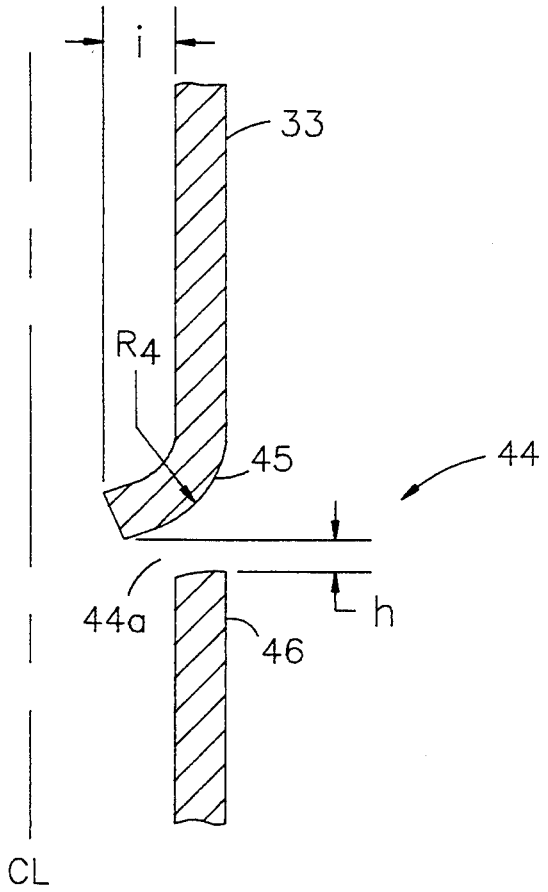
FIG. 13 is a side cross-sectional view of the frown-shaped notch shown in FIG. 12 as defined by Section "BB"

Referring to FIG. 13, the upper lip 45 of the frown-shaped notch 44 extends into the tube 50 and towards the center line CL a distance i of approximately 0.135", and the radius $R_4$ of the upper lip 45 is approximately 0.188". The opening 44(*a*) covered by the frown-shaped notch 44 has a height h of approximately 0.035", and the lower lip 46 of the frown-shaped notch 44 remains substantially planar with respect to the wall 33 of the tube 50.

Referring again to FIGS. 1 and 8, the operation of a lime inhibiting device according to the present invention will be described in relation to a gas water heater. Sediment tends to form on the inside surfaces of the water tank 11, especially along the lower surface of the flue pipe 26 and on the surface of the tank bottom 13 adjacent to the combustion chamber. In conventional water heaters, it was necessary to periodically drain water from tank 11 through outlet 18, attempting to remove at least some sediment along with the water. This procedure required a periodic maintenance regime as well as interruption of use of the water heater and unnecessary waste of energy.

With the integral lime inhibiting device 50 mounted at the cold water inlet port 28 of a gas water heater 10, turbulent water is used instead of laminar-flow water to reduce or eliminate the scaling problem. More specifically, as water passes through the integral lime inhibiting device 50, the smile-shaped notches 34 and frown-shaped notches 44 re-direct the water flow. This induces turbulent flow over a wide range of flow rates. The increased Reynolds Number of the water is so great as to convert laminar and transitional flow to turbulent flow.

Figure 14:
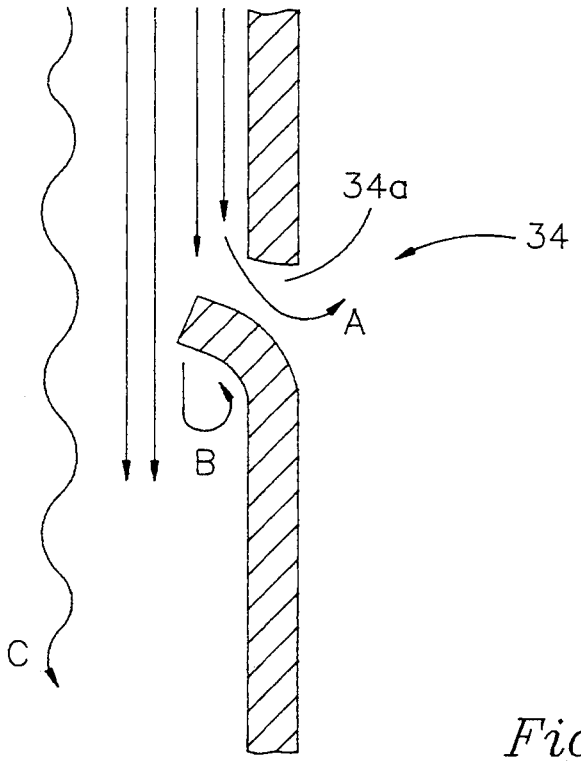
FIG. 14 is a side cross-sectional view of the smile-shaped notch illustrating water flow patterns induced by the notch.

FIG. 14 illustrates the water flow pattern induced by the smile-shaped notch 34. Water flow A passes out through the opening 34(*a*) in the smile-shaped notch 34, thereby allowing the reduction of boundary layer laminar flow by exiting the lime inhibiting device 50. Water flow B is deflected by the smile-shaped notch 34 to induce internal rotating action which creates transitional flow within the lime inhibiting device 50. Water flow C represents the transition period from laminar to turbulent flow from the reduction of boundary layer laminar flow A and the interaction with water flow B.

Figure 15:
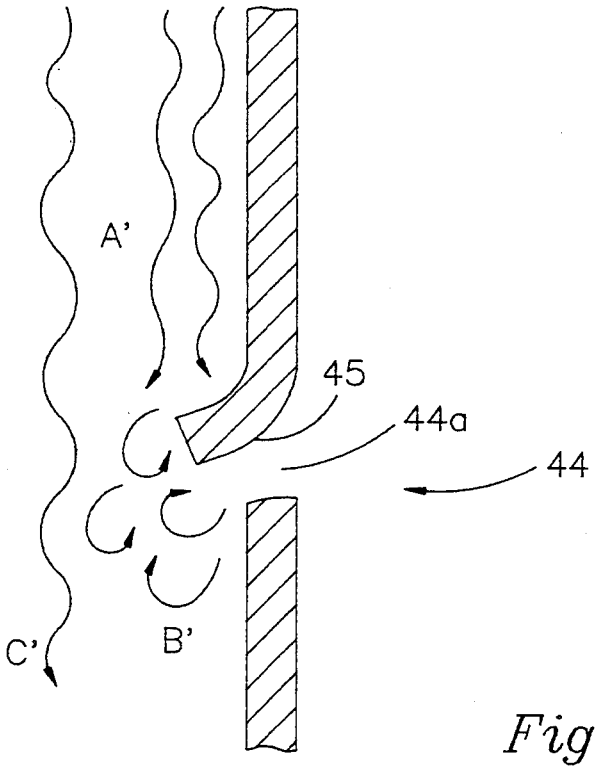
FIG. 15 is a side cross-sectional view of the frown-shaped notch illustrating the water flow induced by that notch.

FIG. 15 illustrates the water flow patterns induced by the frown-shaped notch 44. Water flow A' is directed to the frown-shaped notch 44, which creates an increase in the momentum of the internal rotating action caused by the upper lip 45. Water flow B' is deflected by the frown-shaped notch 44 to create turbulent water flow by the expansion of counter rotating action within the lime inhibiting device 50. Water flow C' represents turbulent flow resulting from interaction between water flows A' and B'. It is also contemplated that water may enter the lime inhibiting device 50 through the opening 44(*a*) in the frown-shaped notch 44.

The introduction of turbulent water into the water tank 11 confers several significant benefits. It creates turbulation within the tank to disturb precipitated and settled attached and loose sediment and suspend those sediments in the circulating water. In turn, the suspended sediment particles are removed from the water tank with hot water when the hot water is drawn. This improves efficiency while extending the life of the tank.

This feature also inexpensively and drastically reduces the need for periodic maintenance.

This invention surprisingly improves water heater capacity which, according to the U.S. Department of Energy, is conventionally measured in terms of a "first hour rating," determined partially by test and partially by calculation. In a direct comparison test between a standard dip tube and an integral lime inhibiting tube according to this invention, a significant improvement in the first hour rating was achieved by this invention, as illustrated by the following example.

EXAMPLE 1

A certified open-ended dip tube was tested in a water heater having a distance of 36 inches from the base of the water tank to the bottom of the spud. The certified dip tube assembly had a length of 26.25 inches and terminated at a distance of 11.75 inches from the bottom of the water tank. After two runs of the first hour rating test according to the Department of Energy procedure, an average first hour rating for the certified open-ended dip tube was calculated to be 56.1 gallons.

The same tests were conducted, also in a water tank having a distance of 36 inches from its base to the bottom of the spud, with an integral lime inhibiting device of this invention replacing the certified open-ended dip tube. The integral lime inhibiting device was prepared according to FIG. 2 and had 10 groups of 3 smile-shaped notches separated by 120°. The tenth, ninth and eighth groups of smile-shaped notches were separated by a distance d of 1.5 inches. The eighth, seventh, sixth, fifth and fourth groups of smile-shaped notches were separated by a distance d of 0.75 inches. The fourth, third, second and first groups of smile-shaped notches were separated by a distance d of 0.375 inches, and the first group of notches was located a distance e of 0.375 inches from the distal end of the integral lime inhibiting device. The distal end of the integral lime inhibiting device terminated at a distance of 4 inches from the bottom of the water tank. After two first hour rating tests were conducted according to the Department of Energy procedure, an average first hour rating of 59.2 gallons was calculated. These results represent approximately a 5% improvement in the first hour rating as compared to certified open-ended dip tubes.

These first hour rating tests were repeated using the embodiment of the integral lime inhibiting device shown in FIGS. 8–13 having the dimensions of the best mode embodiment described above. Those tests exhibited approximately a 7% increase in first hour rating as compared to certified open-ended dip tubes.

The significant increase in first hour rating exhibited by the new integral lime inhibiting system represents an increase of efficiency of the water heater. This allows a reduction of heating time, thereby reducing the NOx emissions of gas water heaters, reducing the production of sediments (which is promoted by heating), and providing significant energy savings.

The increase of circulation of turbulent water also acts to reduce surface boiling at hot spots within the water tank. For example, referring to FIG. 1, surface boiling may occur in a gas water heater along the surface of the flue pipe 26 and along the tank bottom 13. Surface boiling accelerates the precipitation and solidification of sediments, and the increase in water circulation reduces the additional sediment precipitation and solidification associated with surface boiling.

In addition, turbulent flow achieved by this invention reduces "stacking" when hot water is intermittently drawn from the water heater system in small amounts. When hot water is stored in an insulated tank over time, striation or layering occurs forming layers with the hottest layer at the top and the coldest layer at the bottom. Repeated small draws cause repeated heating cycles to be performed, each tending to increase the water temperature at the top layer, especially in gas water heaters having flue pipes extending through the stored hot water, sometimes reaching a temperature significantly above the desired predetermined temperature as set on the thermostat. Because elevated temperatures often accelerate the precipitation and solidification of sediments, the stacking effect also tends to aggravate the problem of sediment build-up.

The so-called "stacking effect" is regulated in terms of "Storage Heater Temperature Limits". The procedure for testing the stacking effect is set forth in Section 2.13.1 of ANSI Standard Z21.10.1. That procedure is summarized as follows.

The water heater is equipped with a thermostat calibrated between 155 and 160 F, and the temperature adjustment means on thermostats provided with adjustable features are set against the high stop. The water heater is filled with water at 65±5F, and a quick-acting valve is installed on the outlet connection of the storage vessel. A flow restricting device adjusted or constructed so as to maintain a flow rate of 3 gallons per minute during test draw periods is connected to the outlet of the valve. A mercury thermometer or thermocouple is placed in the outlet flow stream and a thermocouple is also located in the storage vessel at the thermostat level. A water pressure regulator is placed between the inlet connection to the storage vessel and the water supply line and adjusted so that, at a steady flow rate of 3 gallons per minute, the pressure at the inlet connection will be 40 pounds per square inch. During the test inlet water temperature is maintained at 65±5F.

The water heater is operated at normal inlet test pressure until the thermostat reduces the gas supply to the burner(s) to a minimum. Water is then immediately drawn at the specified draw rate until the thermostat functions, and the maximum outlet temperature is recorded as the maximum initial temperature. This operation is repeated until a constant outlet water temperature is attained. When this condition has been reached, the maximum outlet water temperature is recorded. The outlet water temperature shall not increase more than 30 F above its maximum initial temperature, nor exceed 190° F.

EXAMPLE 2

A direct comparison was made between the integral lime inhibiting device of this invention and a certified open-ended dip tube described above with reference to the first hour rating test. The standard dip tube produced a temperature gradient of 28° F. Using the same procedure, the integral lime inhibiting system shown in FIGS. 5–7 and having the dimensions outlined for deflector 40 was tested. The test results indicated approximately a 17% reduction of "stacking effect".

The turbulating effect is also effective in reducing or eliminating so-called "hot spots" and preventing surface boiling within the water storage tank, both of which are known to increase the precipitation and solidification of sediment.

This further increases the effective hot water supply capacity of the water heater, and ultimately improves its efficiency. In turn, this increased efficiency reduces water heater heating time, thereby minimizing energy costs and NOx emissions in the case of gas heaters and reduces the precipitation and solidification of sediment particulates.

In water heaters with laminar flow inlet tubes it is important to tailor the length of the tube to the length of the water tank. The turbulating function of this invention reduces the critically of the length of the cold water inlet tube. Accordingly, a single, standard sized tube can be used in water heaters of various sizes and capacities. This provides cost-savings including reduced inventory expenses, economies of scale and other related cost savings.

The cold water inlet tube according to the present invention can be mounted vertically in the form of a dip tube, horizontally, or in any other desired orientation, still creating turbulent flow. The cold water inlet tube can be used with energy saving devices such as heat traps.

The new integral lime inhibiting device also utilizes an open-ended tube which does not unduly restrict the flow of water into the water storage tank, as do closed-ended tubes.

If desired, many changes and modifications can be made without departing from the spirit and scope of this invention. The water heater itself can vary in terms of size, structure, and function, number of flues, location of cold water inlet ports, etc.

Although the integral lime inhibiting device has been described in conjunction with gas water heaters it is also useful in electric and other water heaters.

The inlet tube may be formed of various suitable materials, preferably polypropylene, or also from other polymeric materials, tubes or pipes, metallic or other suitable materials. The notches in the wall of the integral lime inhibiting device can be formed in any shape capable of inducing turbulent water flow and are not limited merely to smile-shaped or frown-shaped notches. These notches may be formed in the wall of the integral lime inhibiting device in any known manner, including stamping, molding, or any other formation process. The notches need not penetrate through the tube wall, but preferably do. The smile-shaped and frown-shaped deformations may be arranged in various mixtures and combinations; they need not be in orderly groups, as long as they effectively transpose laminar flow to turbulent flow.

The distance d between axially separated groups of flow deflectors may be constant or may vary. Where notches are used the number of notches and the angle between notches in each axially separated plane may vary, although the use of three notches spaced at approximately 120° is sometimes preferred. While it is preferred that the lower lip 36 of a smile-shaped notch 34 extends farther into the lime inhibiting device 30 than the upper lip 35, the upper lip 35 may extend farther into the flow of water. Similar modifications apply to other shapes and forms of flow deflectors, such as the frown-shaped notches in deflector 40.

It is preferred in some cases that axially separated notches are formed in a single line as shown in FIGS. 2 and 5. However, adjacent groups of notches or otherwise shaped deflectors may also be staggered so that notches are positioned in non-linear arrangement along the wall of the tube.

Although this invention has been described with reference to specific forms selected for illustration in the drawings, and with reference to many variations thereof, it will be appreciated that many other variations may be made without departing from the important feature of converting laminar flow to actively turbulent flow of the incoming water. All such variations, including the substitution of equivalent elements for those specifically shown and described, are within the spirit and scope of the invention as defined in the appended claims.

What is claimed is:

1. A water heater comprising a water storage tank; a water inlet port; and an inlet conduit connected to said port and extending into said tank, said conduit having a passage for water flow;

deflecting means positioned internally of said conduit and having an angularly arranged surface relative to said conduit for deflecting the path of water flow, said deflecting means being constructed and arranged to create turbulent water flow within said conduit and to introduce turbulent water into said water storage tank.

2. The water heater described in claim 1 wherein said deflecting means is in the form of a plurality of notches formed in said conduit, said notches forming lips in the flow path of said water.

3. The water heater described in claim 2 wherein said notches include openings extending through said conduit.

4. An inlet tube for a water heater storage tank, adapted to prevent sediment accumulation in said water heater storage tank, said inlet tube comprising:

(a) a tubular member having a proximal end adapted for mounting to a water heater inlet port and a distal end adapted to be positioned in said tank, said tube having a wall and a water flow passage for introducing water into said tank; and (b) means forming a plurality of water-deflecting notches in said tubular member extending within said passage and into said passage and wall proximal to said distal end of said tubular member.

5. The inlet tube defined in claim 4, each said notch including means providing an opening extending through the wall of said tubular member.

6. The water heater defined in claim 1, said deflecting means comprising one or more tabs extending into said flow passage, and capable of inducing turbulent flow within said flow passage.

7. The water heater defined in claim 1, wherein a plurality of said deflecting means are arranged in a common radial plane extending perpendicular to said flow passage.

8. The water heater defined in claim 1, wherein said deflecting means are provided in a size, number and configuration to cause water turbulence sufficient to suspend tank sediment in said tank for ultimate removal when hot water is drawn.

9. The water heater defined in claim 4, said notches being grouped in planes substantially perpendicular to said passage and axially separated along said tube.

10. The water heater defined in claim 9, wherein three notches are in each said plane, each said notch being equally separated.

11. The water heater defined in claim 9, wherein said notches are linearly arranged along said tube in the direction of said passage.

12. The water heater defined in claim 4, wherein at least a portion of said notches are smile-shaped notches having an upper lip and a lower lip, said lower lip extending farther into said passage than said upper lip.

13. The water heater defined in claim 4, wherein at least a portion of said notches are frown-shaped notches having an upper lip and a lower lip, said upper lip extending farther into said passage than said lower lip.

14. In a gas fired water heater having a burner, a combustion chamber, a water storage tank, a cold water inlet conduit, a hot water outlet port, and a flue extending through said stored water, the improvement comprising a turbulating means providing turbulation to circulate the water in the tank to prevent stacking upon repeated energization of said burner and heating of said flue, said turbulating means comprising an angularly arranged surface relative to said cold water inlet conduit and providing turbulation to suspend sediment in said water for removal with water from the hot water outlet port, and said turbulating means providing turbulation in said tank to stir the water in the tank to increase the output capacity of said gas fired water heater.

* * * * *

US005341770B1

REEXAMINATION CERTIFICATE (3630th)

United States Patent [19] [11] B1 5,341,770

Lannes [45] Certificate Issued Sep. 22, 1998

[54] INTEGRAL LINE INHIBITOR

[75] Inventor: Eric M. Lannes, Kentwood, Mich.

[73] Assignee: Bradford-White Corporation, Ambler, Pa.

Reexamination Request:
No. 90/004,072, Dec. 6, 1995

Reexamination Certificate for:

| | |
|---|---|
| Patent No.: | **5,341,770** |
| Issued: | **Aug. 30, 1994** |
| Appl. No.: | **38,154** |
| Filed: | **Mar. 26, 1993** |

[51] Int. Cl.[6] ..... F22B 37/48
[52] U.S. Cl. ..... 122/383; 122/17; 122/380
[58] Field of Search ..... 122/383, 17, 380, 122/389, 159

[56] References Cited

U.S. PATENT DOCUMENTS

| | | | |
|---|---|---|---|
| 1,790,357 | 1/1931 | Stack . | |
| 2,123,809 | 7/1938 | Seitz | 137/592 |
| 2,592,863 | 4/1952 | Conner | 122/13 |
| 2,602,465 | 7/1952 | Goehring | 137/582 |
| 2,776,200 | 10/1957 | Kaufman | 204/197 |
| 2,825,464 | 3/1958 | Mack . | |
| 3,465,123 | 9/1969 | Harris | 219/328 |
| 3,762,395 | 10/1973 | Taylor | 126/350 R |
| 4,216,092 | 8/1980 | Shalhoob et al. . | |
| 4,505,231 | 3/1985 | Syler | 122/159 |
| 4,549,525 | 10/1985 | Narang | 126/361 |
| 4,662,314 | 5/1987 | Moore, Jr. . | |
| 4,735,174 | 4/1988 | Crump | 122/17 |
| 4,790,289 | 12/1988 | Barrett . | |
| 4,790,291 | 12/1988 | Barrett . | |
| 4,817,564 | 4/1989 | Akkala et al. . | |
| 4,858,563 | 8/1989 | Perry | 122/382 |
| 4,870,927 | 10/1989 | Sundheimer | 122/412 |
| 4,898,150 | 2/1990 | Lewis | 126/361 |
| 4,911,108 | 3/1990 | Akkala et al. . | |
| 4,951,614 | 8/1990 | Akkala et al. . | |
| 4,964,394 | 10/1990 | Threatt | 126/361 |
| 4,972,804 | 11/1990 | Stolmar . | |

FOREIGN PATENT DOCUMENTS

| | | |
|---|---|---|
| B-11717/76 | 3/1978 | Australia . |
| 132112 | 1/1985 | European Pat. Off. . |
| 2183339 | 11/1973 | France . |
| 9007155.7 | 8/1990 | Germany . |

OTHER PUBLICATIONS

Westinghouse European Patent Application, A0132112A3.

*Primary Examiner*—Henry Bennett

[57] ABSTRACT

A water heater cold water inlet deflector means which creates turbulent flow within the inlet conduit and creates turbulent water circulation throughout the water storage tank so that sediment is disturbed and suspended, stacking is prevented and efficiency is improved.

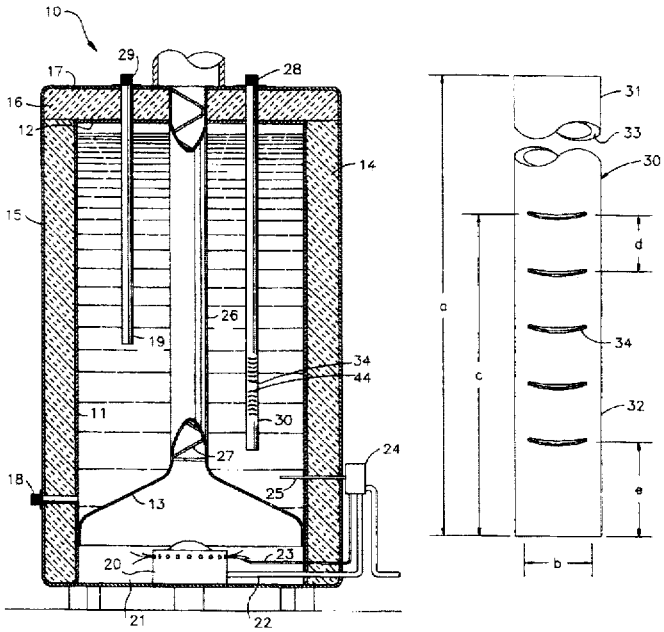

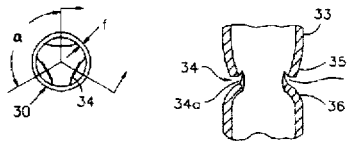

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–14 is confirmed.

New claims 15–31 are added and determined to be patentable.

*15. A water heater having reduced sediment accumulation, said water heater comprising:*

*a water storage tank having a water inlet port through which water enters said water storage tank;*

*an inlet conduit connected to said water inlet port and extending downwardly in said water storage tank and toward a bottom surface of said water storage tank, said inlet conduit having a passage for water flow and an end opening facing said bottom surface of said water storage tank; and*

*deflecting means positioned internally of said inlet conduit and having an angularly arranged surface relative to said inlet conduit for deflecting said water flow, said deflecting means being constructed and arranged to create turbulent water flow within said inlet conduit and to introduce turbulent water into said water storage tank and toward said bottom surface of said water storage tank.*

*16. The water heater described in claim 15, wherein said deflecting means is in the form of a plurality of notches formed in said inlet conduit, said notches forming lips extending into said passage for water flow.*

*17. The water heater described in claim 16, wherein said notches include openings extending through said inlet conduit.*

*18. An inlet tube for a water heater storage tank, adapted to prevent sediment accumulation in said water heater storage tank, said inlet tube comprising:*

*(a) a tubular member having a proximal end adapted for mounting to a water heater inlet port and a distal end adapted to be positioned in said water heater storage tank, said tubular member having a wall and a water flow passage for introducing water downwardly into said water heater storage tank and toward a bottom surface of said water heater storage tank; and*

*(b) means forming a plurality of water-deflecting notches in said tubular member extending within said passage and into said passage and wall proximal to said distal end of said tubular member, said means being constructed and arranged to create turbulent water flow within said tubular member and to introduce turbulent water into said water heater storage tank in a direction to prevent sediment accumulation.*

*19. The inlet tube defined in claim 18, said means providing at least one opening extending through said wall of said tubular member.*

*20. In a gas fired water heater having a burner, a combustion chamber, a water storage tank, a cold water inlet conduit, a hot water outlet port, and a flue extending through said stored water, the improvement comprising a turbulating means providing turbulation to circulate water in said water storage tank to prevent stacking upon repeated energization of said burner and heating of said flue, said turbulating means comprising an angularly arranged surface relative to said cold water inlet conduit positioned within said cold water inlet conduit and providing turbulation directed downwardly toward a bottom surface of said water storage tank to suspend sediment in water for removal with water from said hot water outlet port, and that said turbulating means providing turbulation in said water storage tank to stir water in said water storage tank to increase the output capacity of said gas fired water heater.*

*21. A water heater comprising:*

*a water storage tank;*

*a flue extending through at least a portion of said water storage tank for the exhaust of combustion emissions;*

*a water inlet port;*

*an inlet conduit extending into said water storage tank, said inlet conduit being connected to said water inlet port to deliver water from said water inlet port and into said water storage tank, said inlet conduit being laterally spaced from said flue and having a longitudinal axis extending downwardly into said water storage tank, said inlet conduit having a distal end with an end opening open toward a bottom surface of said water storage tank; and*

*deflecting means for providing turbulent water flow within said inlet conduit and for directing said turbulent water flow into said water storage tank and toward said bottom of said water storage tank, said deflecting means being positioned internally of said inlet conduit and proximal to said distal end of said inlet conduit and having an angularly arranged surface relative to said longitudinal axis of said inlet conduit for deflecting the path of water flow, at least a portion of said angularly arranged surface being spaced from said distal end of said inlet conduit along said longitudinal axis.*

*22. The water heater described in claim 21, wherein said end opening of said inlet conduit is positioned to discharge said turbulent water flow toward said bottom surface of said water storage tank along the general direction of said longitudinal axis of said inlet conduit.*

*23. A water heater comprising:*

*a water storage tank;*

*a flue extending through at least a portion of said water storage tank for the exhaust of combustion emissions;*

*a water inlet port;*

*an inlet conduit extending into said water storage tank, said inlet conduit being connected to said water inlet port to deliver water from said water inlet port and into said water storage tank, said inlet conduit being laterally spaced from said flue and having a longitudinal axis extending downwardly into said water storage tank, said inlet conduit having a distal end with an end opening open toward a bottom surface of said water storage tank; and*

*at least one mixing element for creating turbulent water flow within said inlet conduit and for introducing turbulent water into said water storage tank, said mixing element being positioned internally of said inlet conduit and proximal to said distal end of said inlet conduit and having an angularly arranged surface relative to said longitudinal axis of said inlet conduit,*

*at least a portion of said angularly arranged surface being spaced from said distal end of said inlet conduit along said longitudinal axis.*

*24. An inlet tube adapted to prevent sediment accumulation in a storage tank of a water heater, wherein said inlet tube turbulates water entering said storage tank to suspend sediment in water stored in said storage tank so that the sediment is removed from said storage tank with water as it is introduced to replace water drawn from said water heater during normal usage, said inlet tube comprising:*

*a tubular member having a proximal portion for mounting to a storage tank inlet opening located in a top portion of said storage tank, a distal end portion for positioning in an interior of said storage tank, and a tube inner wall defining a tube inner wall passage extending from said proximal portion in the direction of said distal end portion for delivering water from said inlet opening and into said interior of said storage tank, said distal end portion having an end opening facing a bottom surface of said storage tank, and said tube inner wall passage having a substantially upright axis for directing water downwardly into said storage tank and toward said bottom surface of said storage tank; and*

*a water turbulator positioned substantially adjacent and within said distal end portion of said tubular member, said water turbulator having at least one curved surface adjacent said tube inner wall of said tubular member and extending into said tube inner wall passage, said curved surface being oriented at an angle to said axis of said tube inner wall passage and being shaped to deflect water at an angle with respect to said axis of said tube inner wall passage as said water flows through said tube inner wall passage, past said water turbulator, through said end opening of said tubular member, and into said interior of said storage tank to impact said bottom surface.*

*25. The inlet tube defined in claim 24, wherein said water turbulator has a plurality of curved surfaces positioned along said axis of said tube inner wall passage, at least a portion of said curved surfaces being spaced from said end opening in said tubular member, said curved surfaces coacting to provide accumulated deflection of water as water flows through said tube inner wall passage and past said water turbulator.*

*26. The inlet tube defined in claim 25, said curved surfaces being spaced from one another along said tube inner wall.*

*27. The inlet tube defined in claim 26, wherein at least one of said curved surfaces is positioned adjacent said tube inner wall at a location downstream from another one of said curved surfaces in a direction along said axis of said tube inner wall.*

*28. A water heater for providing heated water for domestic use or consumption and having a water storage tank, said water heater comprising:*

*a water storage tank having an upper portion, a bottom surface, and an interior region between said upper portion and said bottom surface in which water is contained, wherein sediment tends to precipitate and move downwardly to said bottom surface of said water storage tank during normal use of said water heater;*

*an inlet conduit having a proximal portion for mounting to a water storage tank inlet port positioned in said upper portion of said water storage tank, a distal end portion for positioning in said interior region of said water storage tank, and a conduit inner wall defining a conduit inner wall passage extending from said proximal portion in the direction of said distal end portion for delivering water from said inlet port and into said interior region of said water storage tank, said distal end portion having an end opening facing said bottom surface of said water storage tank, and said conduit inner wall passage having a substantially upright axis for directing water downwardly into said water storage tank and toward said bottom surface of said water storage tank; and*

*a water turbulator positioned substantially adjacent and within said distal end portion of said inlet conduit, said water turbulator having at least one curved surface adjacent said conduit inner wall of said inlet conduit and extending into said conduit inner wall passage, said curved surface being oriented at an angle to said axis of said conduit inner wall passage and being shaped to deflect water at an angle with respect to said axis of said conduit inner wall passage as said water flows through said conduit inner wall pasage, past said water turbulator, through said end opening of said inlet conduit, and into said interior region of said water storage tank to impact said bottom surface;*

*said water turbulator having capacity for reducing accumulation of said sediment on said bottom surface of said water storage tank and suspending said sediment in water contained in said water storage tank for removal from said interior region of said water storage tank as water is drawn from said water heater for use, thereby increasing the longevity of said water heater; and*

*said water turbulator having capacity for reducing stacking in said interior region of said water storage tank and encouraging a substantially uniform distribution of heat throughout said water storage tank, thereby increasing the operating efficiency of said water heater.*

*29. The water heater defined in claim 28, wherein said water turbulator has a plurality of curved surfaces positioned along said axis of said conduit inner wall passage, at least a portion of said curved surfaces being spaced from said end opening in said inlet conduit, said curved surfaces coacting to provide accumulated deflection of water as water flows through said conduit inner wall passage and past said water turbulator.*

*30. The water heater defined in claim 29, wherein said curved surfaces are spaced from one another along said conduit inner wall.*

*31. The water heater defined in claim 30, wherein at least one of said curved surfaces is positioned adjacent said conduit inner wall at a location downstream from at least one other of said curved surfaces along said axis of said conduit inner wall.*

* * * * *